US006341588B2

(12) United States Patent
Kobayashi et al.

(10) Patent No.: US 6,341,588 B2
(45) Date of Patent: Jan. 29, 2002

(54) VALVE SPRING RETAINER AND A VALVE OPERATING MECHANISM

(75) Inventors: Haruki Kobayashi; Makoto Abe; Takeshi Sassa, all of Fujisawa (JP)

(73) Assignee: Fuji Oozx, Inc, Kanagawa-ken (JP)

( * ) Notice: Subject to any disclaimer, the term of this patent is extended or adjusted under 35 U.S.C. 154(b) by 0 days.

(21) Appl. No.: 09/921,742

(22) Filed: Aug. 3, 2001

Related U.S. Application Data

(62) Division of application No. 09/661,713, filed on Sep. 14, 2000, now Pat. No. 6,293,240.

(30) Foreign Application Priority Data

Mar. 28, 2000 (JP) ..... 2000-089109
Mar. 28, 2000 (JP) ..... 2000-089110
Apr. 27, 2000 (JP) ..... 2000-127108

(51) Int. Cl.[7] ..... F01L 3/10
(52) U.S. Cl. ..... 123/90.67; 123/188.13; 251/337
(58) Field of Search ..... 123/90.67, 188.13; 251/337

(56) References Cited

U.S. PATENT DOCUMENTS 1,595,317 A * 8/1926 Scholey ..... 251/322
2,650,579 A * 9/1953 Bernight ..... 123/90.37
4,154,424 A * 5/1979 Cherrie ..... 251/337
4,879,978 A * 11/1989 Pierce ..... 123/90.67
4,993,376 A * 2/1991 Fukutome et al. ..... 123/90.65
5,884,596 A * 3/1999 Hara et al. ..... 123/90.65

FOREIGN PATENT DOCUMENTS

| | | |
|---|---|---|
| JP | 62-90907 | 6/1987 |
| JP | 62182410 | 8/1987 |
| JP | 4-30 | 1/1992 |
| JP | 4-134608 | 12/1992 |
| JP | 10-317926 | 12/1998 |
| JP | 2000-161029 | 6/2000 |

* cited by examiner

*Primary Examiner*—Weilun Lo

(57) ABSTRACT

A valve spring retainer is mounted to the upper end of a poppet valve via a pair of cotters in an internal combustion engine of an automobile. The valve spring retainer has an intermediate portion and an outer flange which is engaged with the upper end of a valve spring. The lower surface has a gap between the outer flange and the intermediate portion to decrease wear which is caused by engagement with the valve spring. There is also provided a valve operating mechanism which has a valve spring retainer which has a projection on the lower surface so as to prevent wear.

3 Claims, 8 Drawing Sheets

VALVE SPRING RETAINER AND A VALVE OPERATING MECHANISM

CROSS-REFERENCE TO RELATED APPLICATION

This application is a division of application Ser. No. 09/661,713 filed Sep. 14, 2000 now U.S. Pat. No. 6,293,240.

BACKGROUND OF THE INVENTION

The present invention relates a valve spring retainer and a valve operating mechanism in an internal combustion engine.

FIG. 10 is one example of a conventional valve operating mechanism in an internal combustion engine, in which a valve spring retainer 3 is mounted at the upper end of a poppet valve 1 by a pair of cotters 2,2. A valve spring 4 is provided between the lower surface of an outer flange 3*a* of the valve spring retainer 3 and a cylinder head (not shown), so that the poppet valve 1 is always energized upwards by the valve spring 4.

The numeral 5 denotes a rocker arm which is engaged on the axial end of the poppet valve 1 and which is moved up and down by a rotary cam (not shown), so that the poppet valve 1 is opened and closed.

The flange 3*a* of the valve spring retainer 3 of the valve operating mechanism has a horizontal lower surface perpendicular to an axis of the valve spring retainer 3, and is adapted to contact the upper surface of the valve spring 4 when the valve spring 4 is equipped.

It is inevitable to wear the lower surface of the flange 3*a* of the retainer 3 owing to relatively rotational or radial movement of the valve spring 4 caused by vibration when the poppet valve is seated.

Especially, in an automobile engine which is accelerated or decelerated frequently, as illustrated in FIG. 11, when the valve spring 4 is compressed, the uppermost winding is twisted outwards as shown by a downward arrow, or the flange 3*a* is bent upwards by reaction force to compression as shown by an upward arrow when the valve spring 4 is compressed.

In the conventional valve spring retainer 3 in which the lower inner surface of the flange 3*a* is horizontal, the inner upper circumference of the first winding which is horizontal at the upper end of the valve spring is engaged with the lower surface of the flange 3*a*, so that a larger surface pressure is applied.

Thus, as shown in FIG. 12, at the beginning of operation, the lower inner portion of the flange 3*a* locally wears, and develops outwards as shown by dotted lines. Especially, in the valve spring retainer 3 made of Al alloy for decreasing weight, wear develops rapidly.

Also, owing to vibration in opening and closing of the poppet valve 1 or surging in the valve spring 4, the flange 3*a* of the retainer 3 is rotated with respect to the valve spring 4, thereby causing contact surfaces to wear away. Especially, in the Al alloy valve spring retainer 3 for lightening, wear to the valve spring retainer 3 becomes larger.

As wear becomes larger, setting load of the valve spring 4 becomes smaller to decrease the maximum rotation speed of surging, thereby decreasing engine performance. Depending on degree in wear, it becomes necessary to replace the retainer 3 with a new one.

SUMMARY OF THE INVENTION

In view of the disadvantages in the prior art, it is an object of the present invention to provide a valve spring retainer in which the lower surface of a flange is modified in shape to decrease wear, thereby increasing durability and reliability.

It is another object of the present invention to provide a valve operating mechanism of an internal combustion engine in which a valve spring retainer is prevented from rotation with respect to a valve spring to keep wear of the contacting surfaces at minimum.

BRIEF DESCRIPTION OF THE DRAWINGS

The features and advantages of the present invention will become more apparent from the following description with respect to embodiments as shown in appended drawings wherein.

DETAILED DESCRIPTION OF THE PREFERRED EMBODIMENTS

Figure 1:
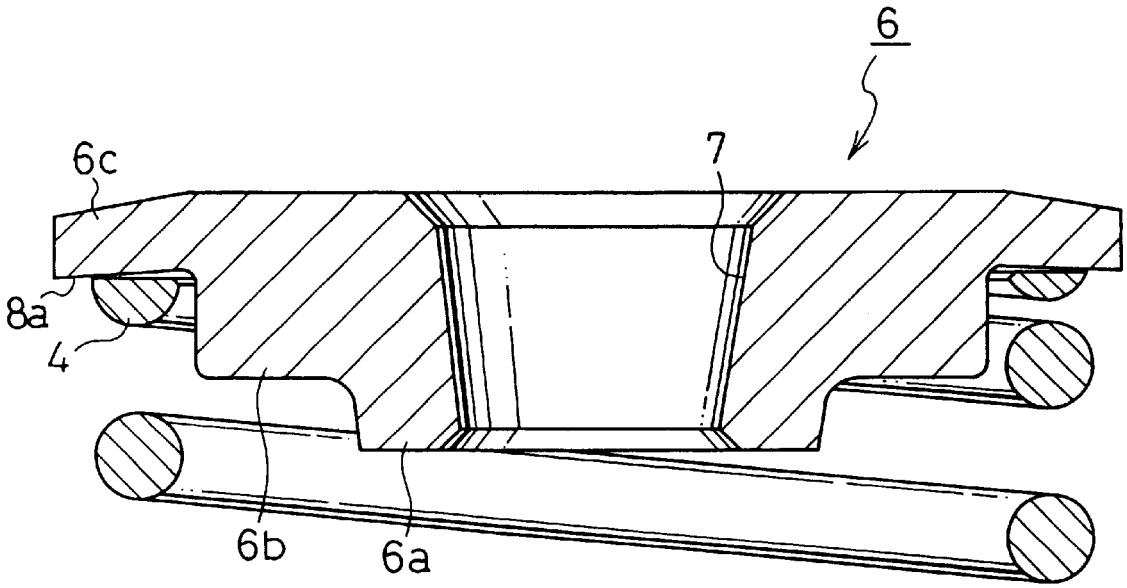
FIG. 1 is a central vertical sectional front view of the first embodiment of a valve spring retainer according to the present invention.
Figure 2:
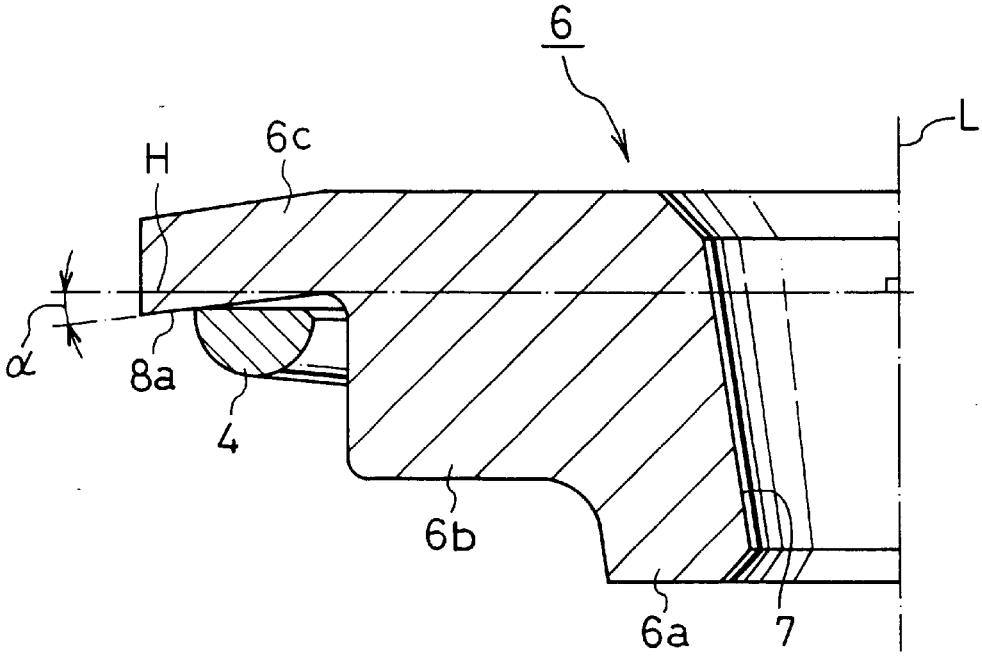
FIG. 2 is an enlarged sectional view thereof.
Figure 3:
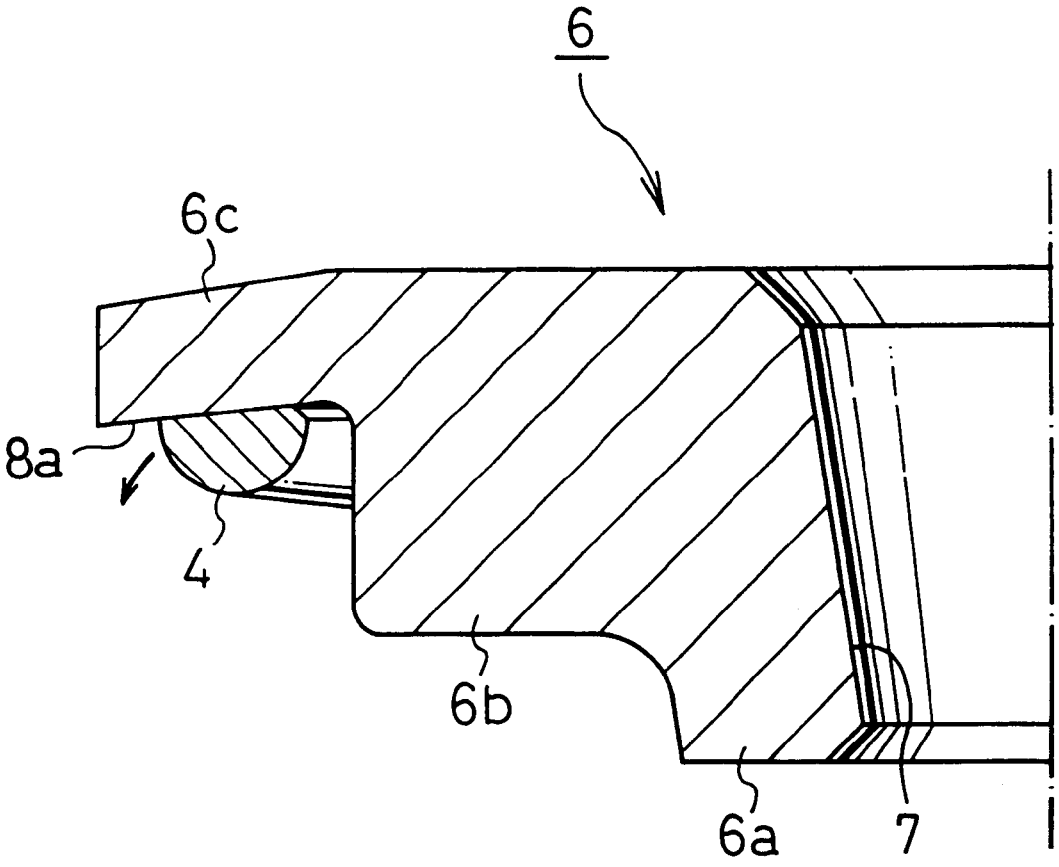
FIG. 3 is an enlarged sectional view which shows how to contact the valve spring when it is twisted.

FIG. 1 illustrates the first embodiment of the present invention, in which a valve spring retainer 6 according to the present invention is molded by Al alloy such as Al—Si and Al—Cu and formed by T6 treatment under the Japanese Industrial Standards. The valve spring retainer 6 comprises an inner portion 6*a* which surrounds a taper bore 7, an intermediate portion 6*b* and an outer flange 6*c* which is engaged with the upper end of the valve spring 4. As shown in FIG. 2, the lower surface 8 of the outer flange 6*c* is slightly inclined by an angle "α" with respect to a horizontal line "H" perpendicular to an axis "L" of the valve spring retainer 6.

The angle "α" is determined by material of the valve spring retainer 6 or a spring constant or load to be set of the valve spring. Preferably, an ordinary Al alloy valve spring retainer for a gasoline engine may have an angle of less than 1°.

The lower surface 8*a* of the outer flange 6*c* is radially inclined downwards toward the outer circumference. When the valve spring 4 is mounted as shown in FIG. 2, the uppermost winding is engaged with the lower surface of the outer flange 6*c*. When the engine is accelerated and decelerated, the uppermost winding of the valve spring 4 is compressed and twisted by the valve spring retainer 6 and the outer flange 6*c* gives upwards. Then, the uppermost flat surface of the valve spring 4 is engaged with the lower surface 8*a* of the outer flange 6*c*.

The inner portion of the outer flange 6*c* is prevented from wearing locally. The lower surface is prevented from wearing at broad extent. As a result, setting load of the valve spring 4 decreases, and decrease in the maximum rotation speed is prevented, so that engine performance is kept suitable for a long time.

An angle "α" of the lower surface 8 of the outer flange 6*c* may be less than 1°. If it is more than 1° surface pressure of the portion which contacts the valve spring will be too high, thereby increasing wear in the circumference of the lower surface 8.

Figure 4:
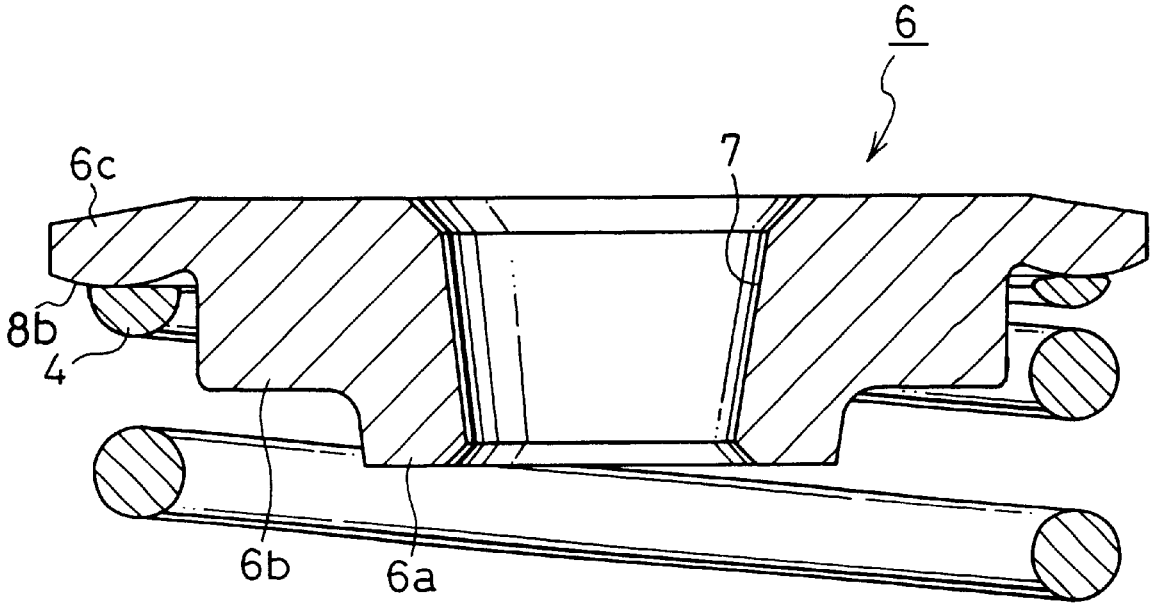
FIG. 4 is a central vertical sectional front view of the second embodiment of a valve spring retainer according to the present invention.
Figure 5:
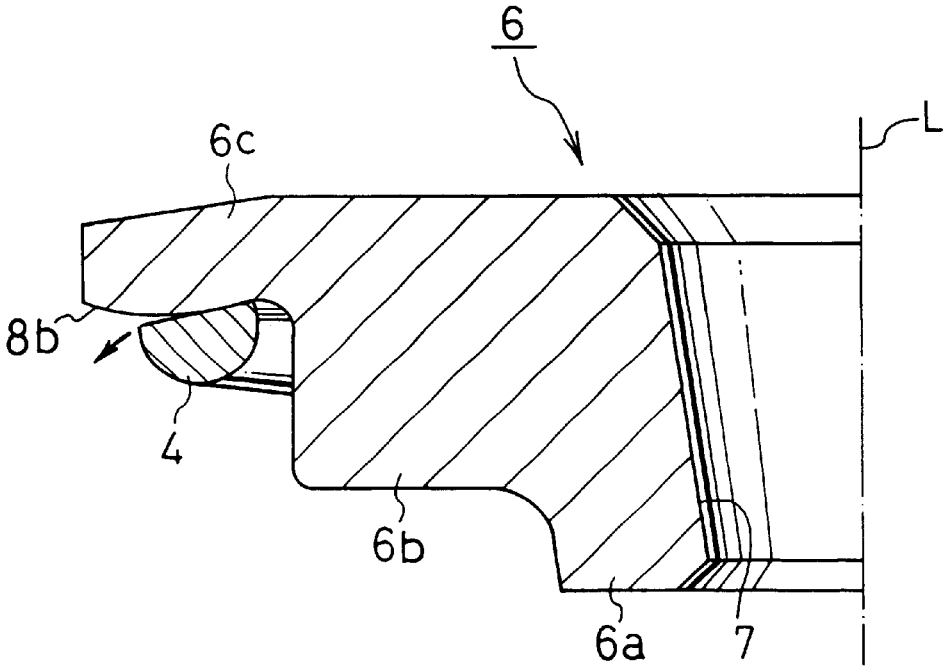
FIG. 5 is an enlarged sectional view thereof.

The present invention is applied to relatively soft Al alloy valve spring retainer as mentioned above, but may be applied to an ordinary steel valve spring retainer In FIGS. 4 and 5, the second embodiment of the present invention will be illustrated. The lower surface 8*b* of an outer flange 6*c* is formed as an arcuate section. By the second embodiment of the present invention, similar advantages to the above are achieved.

Figure 6:
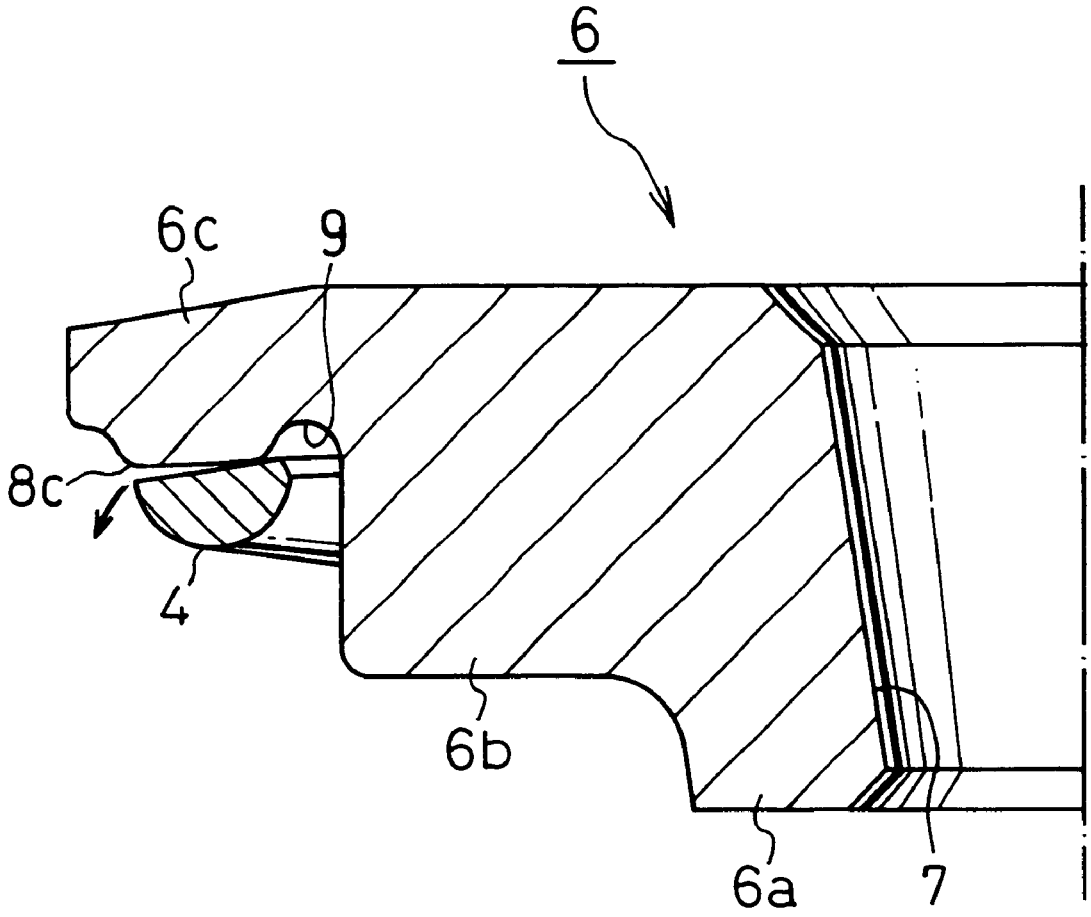
FIG. 6 is an enlarged sectional view of the third embodiment of a valve spring retainer according to the present invention.

In FIG. 6, the third embodiment of the present invention is illustrated. The lower surface of an outer flange 8 is formed as an inverse-trapezoid-section, and an annular recess 9 is formed between an intermediate portion 6*b* and the outer flange 6*c*. The width of the recess 9 is determined such that the uppermost inner edge of the valve spring does not get out of the recess 9 even if the valve spring is moved radially at maximum. In the third embodiment, if the valve spring is twisted outwards, the inner edge gets in the recess 9 to form a gap between the outer flange and the intermediate portion, thereby preventing the lower surface of the outer flange 6*c* from wearing locally. In the third embodiment, only the recess 9 may be formed without projection of the lower surface 8*c* of the outer flange 6*c*. To prevent stress from concentrating to the recess, the recess 9 may have an arc which has relatively large radius.

Figure 7:
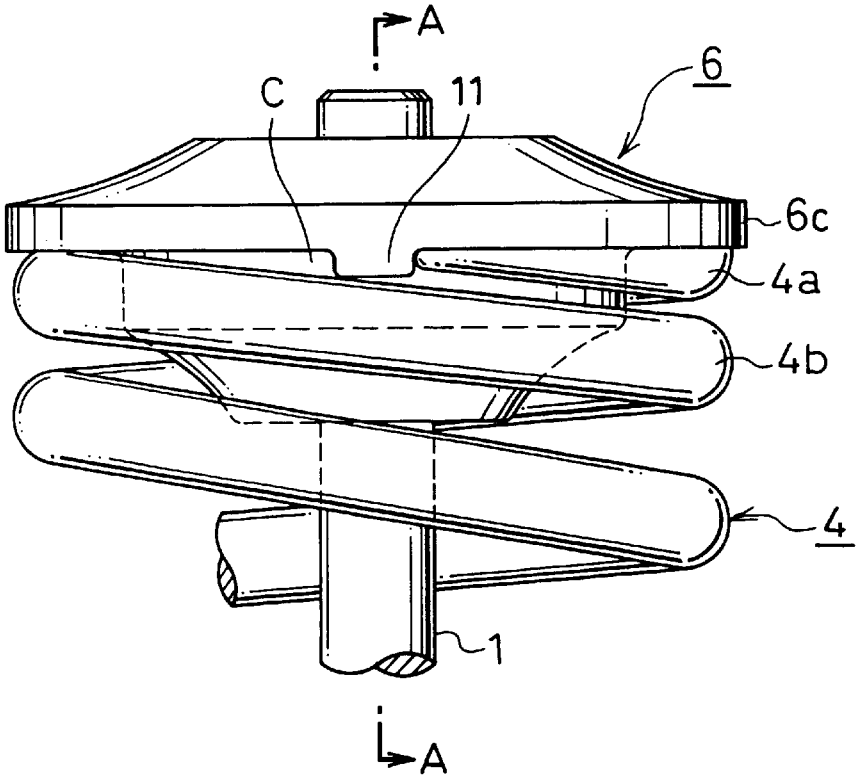
FIG. 7 is a front elevational view of the first embodiment of a valve operating mechanism according to the present invention.
Figure 8:
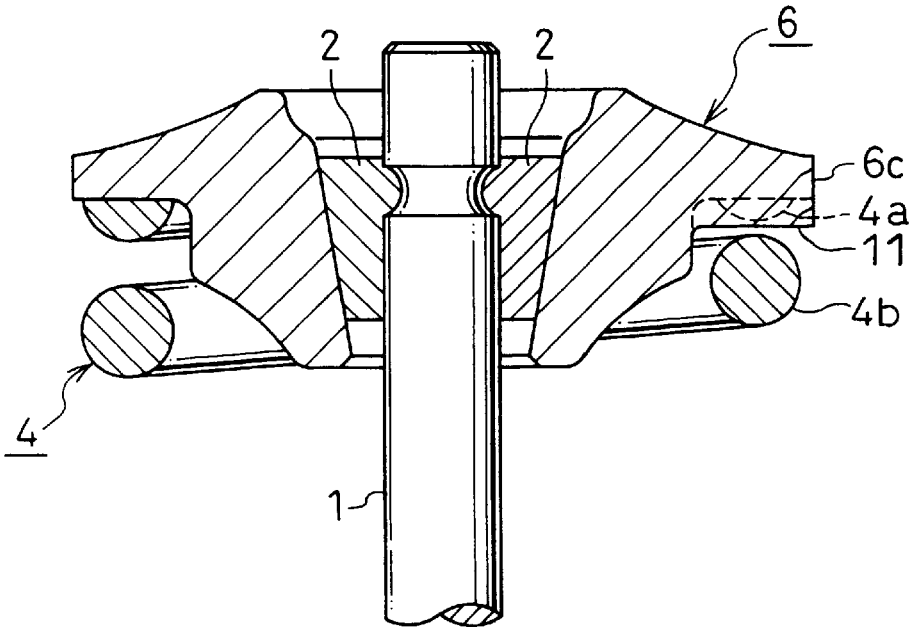
FIG. 8 is a vertical sectional side view taken along the line A—A in FIG. 7.

In FIGS. 7 and 8, the first embodiment of a valve operating mechanism according to the present invention is disclosed. A valve spring retainer 6 is made of Al alloy, and mounted to the axial end of a poppet valve 1 via a pair of cotters 2, 2, On the lower surface of an outer flange 6*c* of the valve spring retainer 6, a projection 11 is partially formed and inserted into an opening "C" which is formed between the uppermost first winding 4*a* and the second winding 4*b* of the valve spring 4.

Height and circumference of the projection are determined by the following way. As shown in FIG. 7, the valve spring retainer 6 is mounted such that the projection 11 is positioned in the opening "C". The right side of the projection 11 is engaged with the end of the first winding 4*a* of the valve spring 4, and the left lower corner of the projection 11 is positioned closely to the upper surface of the second winding which is inclined upwards to the left.

In the valve operating mechanism of the present invention, if the valve spring 4 is rotated with respect to the valve spring retainer 6 around an axis, the right side of the projection 11 is engaged with the end of the first winding 4*a* and the left lower corner is engaged with the upper surface of the second winding 4*b*.

Thus, sliding friction between the upper end of the valve spring 4 and the outer flange 6*c* almost disappears, thereby greatly decreasing wear of the valve spring retainer 6 made of Al alloy.

Figure 9:
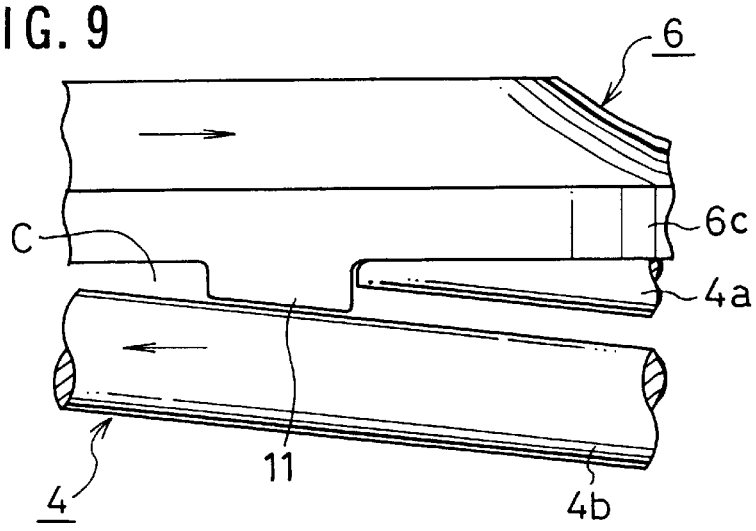
FIG. 9 is an enlarged front view of the second embodiment of a valve operating mechanism according to the present invention.
Figure 10:
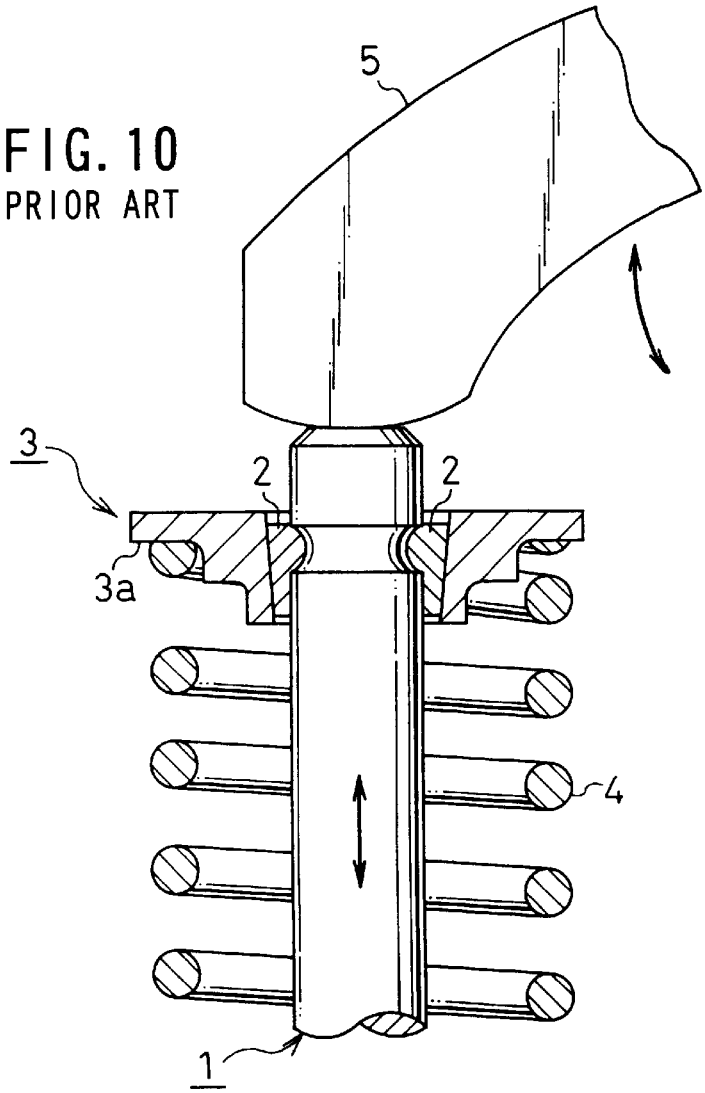
FIG. 10 PRIOR ART
FIG. 10 is a central vertical sectional front view which shows a conventional valve operating mechanism.
Figure 11:
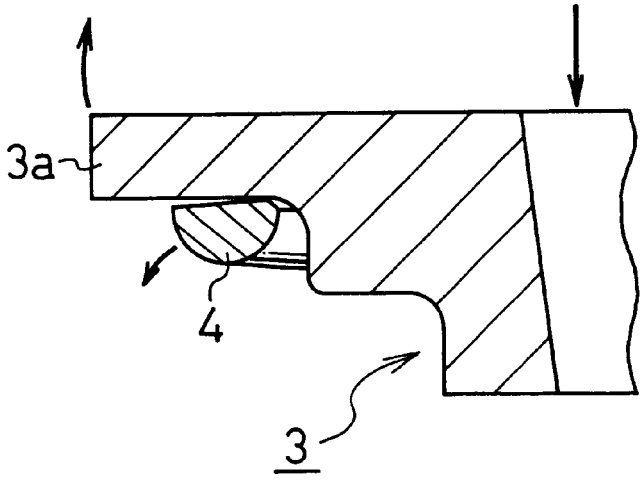
FIG. 11 PRIOR ART
FIG. 11 is an enlarged sectional view of a conventional valve spring retainer which shows how to contact a valve spring when it is twisted.
Figure 12:
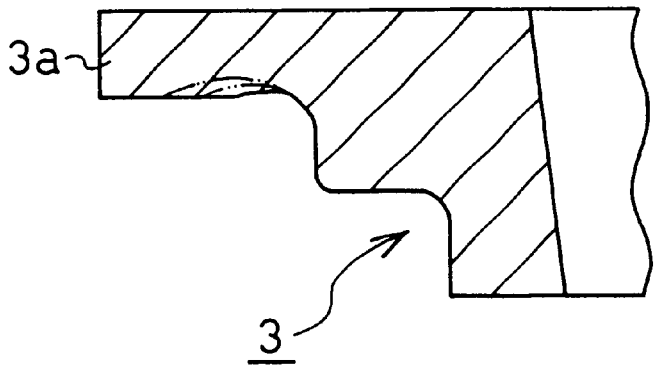
FIG. 12 PRIOR ART
FIG. 12 is an enlarged front view thereof which shows how to wear in an outer flange.

FIG. 9 is the second embodiment of a valve operating mechanism of the present invention, in which the lower surface of a projection 11 is inclined at almost the same angle as that of a second winding 4*b* of a valve spring 4. When the valve spring 4 and a valve spring retainer 6 are rotated in directions as shown by arrows respectively, contact area between the lower surface of the projection 11 and the upper surface of the second winding 4*b* of the valve spring 4 increases to decrease surface pressure, thereby decreasing wear of the contact surfaces.

Figure 13:
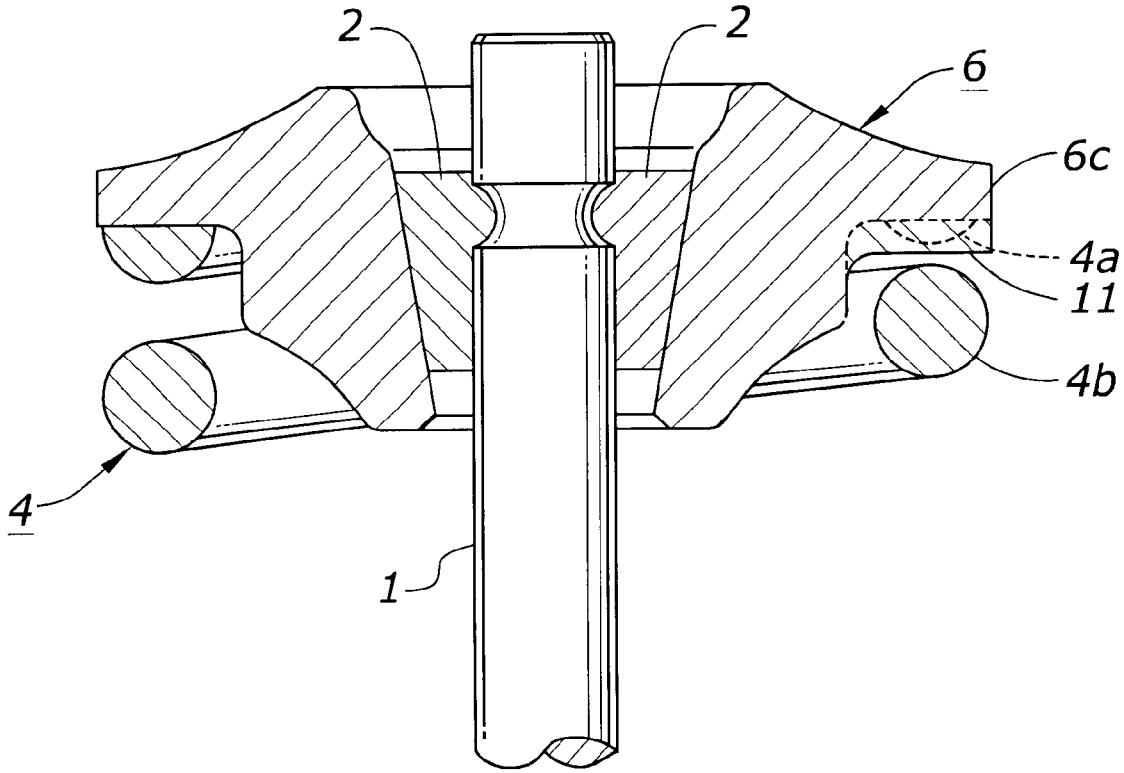
FIG. 13 is a vertical sectional side view taken along the line A—A in FIG. 7 depicting the projection 11 as a separate piece from the remaining device.

The valve operating mechanism according to the present invention is not limited to the embodiments as above. In the embodiment, the projection 11 is part of the retainer 6, but may be separately formed and fixed to an outer flange 6*a* of a valve spring retainer 6 by means of welding or a screw. The projection 11 may be made of hard steel or light Ti alloy to increase wear resistance, as shown in FIG. 13. The valve operating mechanism of the present invention may be applied to what has a steel valve spring retainer.

The foregoing merely relate to embodiments of the present invention. Various modifications and changes may be made by person skilled in the art without departing from the scope of claims wherein.

What is claimed is:

1. A valve operating mechanism for reciprocating a poppet valve in an internal combustion engine, said mechanism comprising:

a valve spring retainer which is mounted to an end of the poppet valve and has an outer flange; and a valve spring which is provided between a lower surface of the outer flange and a cylinder bead, a downward projection being fixed to the lower surface of said outer flange and located in an opening between an end of an uppermost first winding and an upper surface of a second winding of the valve spring, wherein the valve spring retainer is made of light alloy, the projection being made of material harder than the retainer.

2. The valve operating mechanism of claim 1 wherein the valve spring retainer is made of Al alloy.

3. The valve operating mechanism of claim 1 wherein the valve spring retainer is mounted to an end of the poppet valve via a pair of cotters.

* * * * *